United States Patent [19]

Airaksinen

[11] Patent Number: 5,014,883

[45] Date of Patent: May 14, 1991

[54] PAINT TONER DISPENSING MACHINE

[75] Inventor: Pentti Airaksinen, Ulvila, Finland

[73] Assignee: Cimcorp Oy, Ulvila, Finland

[21] Appl. No.: 401,437

[22] PCT Filed: Mar. 17, 1988

[86] PCT No.: PCT/FI88/00038

§ 371 Date: Sep. 14, 1989

§ 102(e) Date: Sep. 14, 1989

[87] PCT Pub. No.: WO88/06979

PCT Pub. Date: Sep. 22, 1988

[30] Foreign Application Priority Data

Mar. 20, 1987 [FI] Finland ..... 871240

[51] Int. Cl.[5] ..... B65D 88/54

[52] U.S. Cl. ..... 222/318; 222/377; 222/380; 222/504; 222/510; 137/862; 137/872

[58] Field of Search ..... 222/377, 380, 504, 318, 222/510; 417/310, 440; 137/569, 872, 862

[56] References Cited

U.S. PATENT DOCUMENTS

| | | | |
|---|---|---|---|
| 1,992,736 | 2/1935 | Bronander et al. | 222/318 X |
| 2,545,588 | 3/1951 | Pulse | 222/318 X |
| 2,566,702 | 9/1951 | Harrigan | 222/318 X |
| 2,652,175 | 9/1953 | Davis | 222/510 X |
| 2,660,336 | 11/1953 | Coffey et al. | 137/569 X |
| 3,042,259 | 7/1962 | Engel | 222/318 |
| 3,168,225 | 2/1965 | Miller et al. | 222/380 |
| 3,459,340 | 8/1969 | Smith | 222/380 |
| 3,807,607 | 4/1974 | Kuckens | 222/510 X |
| 4,363,426 | 12/1982 | Heinzl | 222/380 X |
| 4,708,269 | 11/1987 | Willerding | 222/377 |

FOREIGN PATENT DOCUMENTS

| | | |
|---|---|---|
| 304941 | 7/1968 | Sweden . |
| 362387 | 10/1973 | Sweden . |
| 453811 | 3/1988 | Sweden . |

*Primary Examiner*—Michael S. Huppert
*Assistant Examiner*—Gregory L. Huson
*Attorney, Agent, or Firm*—Fitch, Even, Tabin & Flannery

[57] ABSTRACT

A paint toning machine comprising a plurality of color paste containers (1); a pump (2) for each paste container (1) for pumping color paste (3) for the dispensing and circulation thereof; and a dispensing valve (11) for each pump (2) for dispensing a desired amount of color paste. For the elimination of the problems caused by leaks occurring in the dispensing valve and the pipe connections thereof, the dispensing valve (11) according to the invention is arranged in the paste container (1) in the vicinity of a bottom (4) thereof essentially below the surface of the color paste (3) contained in the container.

3 Claims, 1 Drawing Sheet

PAINT TONER DISPENSING MACHINE

Figure 2:
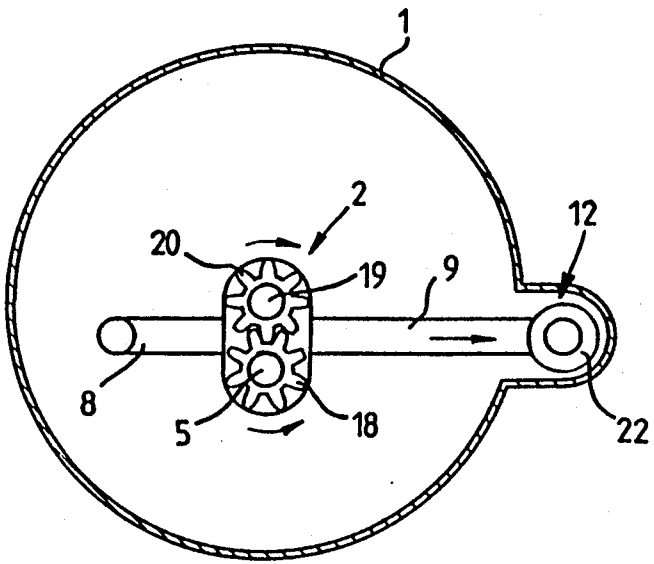

This invention relates to a paint toning machine comprising a plurality of color paste containers, a pump for each paste container for pumping color paste for the dispensing and circulation thereof, and a dispensing valve attached to each pump for dispensing a desired amount of color paste.

A paint toning machine of the above type is known e.g. from Australian Patent Specification 162 212. Therein the dispensing valves are positioned on the circumference of a semicircle so that the desired dispensing valve can be turned above a paint pot containing paint to be toned for dispensing. Thus the dispensing valve is positioned relatively far from the dispensing pump positioned in the vicinity of the color paste container, wherefore it has to be provided with rather long hose connections for a color paste dispensing conduit and a return conduit. The color paste normally circulates in the dispensing and return conduits so that it is mixed and stays homogeneous, and the dispensing is carried out by controlling the dispensing valve, whereby the color paste can be passed from the dispensing conduit to the dispensing nozzle. A problem with this kind of arrangement, however, is that the couplings of the hose connections to the dispensing valves as well as the structure of the dispensing valve itself are liable to leakage, especially in cases where the color paste is solvent-diluted, whereby it penetrates extremely easily even through minor gaps. Such leaks may result in operational disturbances in the dispensing valve, and they may even cause the color paste to be dried either in the valve or in the dispensing and return conduits attached thereto so that the conduits may clog.

The object of the present invention is to eliminate the problems possibly caused by such leaks. A paint toning machine according to the invention by means of which this object can be achieved is characterized in that the dispensing valve is arranged in the paste container in the vicinity of the bottom thereof essentially below the surface of the color paste contained in the container.

By immersing the dispensing valve in the color paste, problems caused by possible leaks in the valve can be fully eliminated. The immersion of the valve in the color paste is preferably carried out in such a manner that a drive shaft of the dispensing valve projects outside the paste container preferably through a hole formed in the cover of the paste container. In this way, the operating means of the dispensing valve can be positioned outside the paste container, so that it can be completely conventional in structure.

In a preferred embodiment of the invention, the dispensing valve comprises a valve spindle having a first conical surface for closing a paste circulation conduit and a second conical surface for closing a paste dispensing conduit, whereby a counter surface for the first conical surface is formed in a floor positioned above the bottom of the paste container, and a counter surface for the second conical surface of the spindle is formed in the bottom of the paste container, whereby a paste feeding conduit connected to the dispensing valve is positioned between the bottom and the floor. In this way the dispensing valve and the paste dispensing and circulation conduits attached thereto can be formed by means of the paste container and other structural parts which are simple and inexpensive to manufacture. The drive shaft of the dispensing valve is vertical and so positioned that it goes through the floor via the paste circulating conduit. Thus the dispensing valve merely requires a short to-and-fro movement for the operation thereof, and this can be effected simply by means of e.g. a magnetic operating means provided with a return spring.

Figure 1:
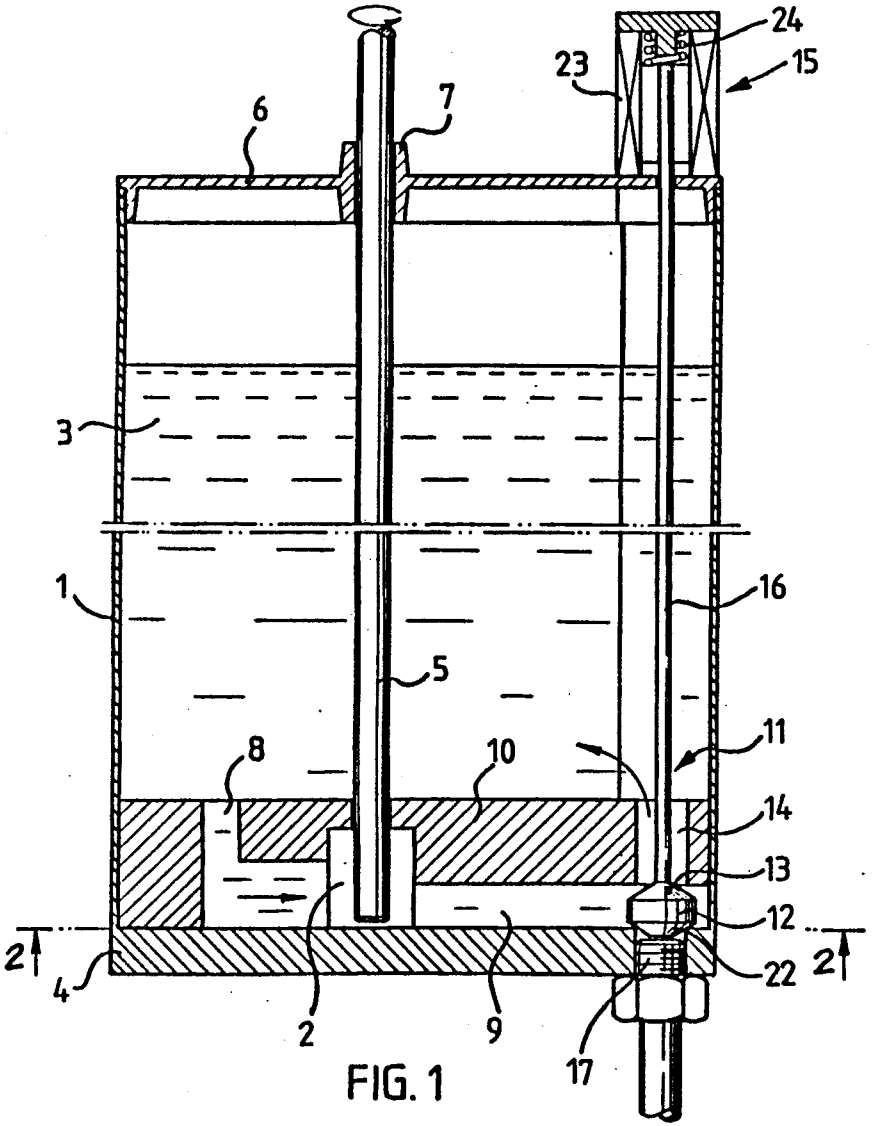

In the following the paint toning machine according to the invention will be described in more detail with reference to the attached drawing, wherein FIG. 1 shows a cross-section of one paste container of the paint toning machine according to the invention, and FIG. 2 shows a section of the paste container of FIG. 1 along the line 2—2 shown in the same figure.

FIG. 1 shows one of a plurality of paste containers comprised in the paint toning machine according to the invention; this container is indicated with the reference numeral 1. A gear-type pump 2 is immersed in the color paste contained in the paste container, and a drive shaft 5 of the pump goes through a cover 6 of the container through hole 7. The cover 6 of the container is arranged on the container 1 as tightly as possible. Suction and pressure conduits 8 and 9 for the pump 2 are formed by means of a floor 10 positioned above a container bottom 4. The floor 10 also forms a structural part of a dispensing valve 11 attached to the color paste container 1 in such a manner that it forms a counter surface for an upper conical surface 13 of a spindle 12 of the dispensing valve 11. The spindle 12 of the valve 11 also comprises a lower conical surface 22 which closes a color paste dispensing conduit 17 going through the bottom 4 of the paste container 1 when the spindle 12 of the dispensing valve is in the position shown in FIG. 1. Thereby the upper conical surface 13 of the valve is not positioned against the counter surface thereof so that it leaves open the essentially vertical color paste circulation conduit 14 going through the floor 10. The color paste 3 thereby circulates in the container 1 along a path shown by the dark arrows when the pump 2 is on. Color paste is thereby sucked from the container 1 through the suction conduit 8 of the pump 2 and it enters the circulation conduit 14 through the feeding conduit 9 past the conical surface 13 of the spindle 12 of the dispensing valve 11, and then returns to the container 1. This circulation keeps the color paste homogeneous in the container. A drive shaft 16 of the dispensing valve 11 extends from the spindle 12 of the valve through the circulation conduit 14 and further through the cover 6 of the color paste container 1 through a hole 21 to a valve operating means 15, the operating means comprising a magnet coil 23 and a return spring 24. When the magnet coil 23 is energized, the drive shaft 16 rises upwards so that the conical surface 13 of the valve spindle 12 closes the color paste circulation conduit 14, and the pressure conduit 9 from the pump 2 joins the color paste dispensing conduit 17, going past the conical surface 22 of the valve spindle 12 and further to a color paste dispensing nozzle (not shown). When the current to the magnet coil 23 is switched off, the return spring 24 returns the drive shaft 16 to the lower position, thus closing the color paste dispensing conduit 17 and opening the color paste circulation conduit 14.

FIG. 2 shows a section of the color paste container of FIG. 1 along the line 2—2 shown in FIG. 1. It appears from FIG. 2 that the pump 2 is a gear-type pump comprising a primary gearwheel 18 attached to the drive shaft 5 and a secondary gear wheel 20 attached to a support shaft 19. As is to be seen in FIG. 2, the color paste container 1 is essentially round in shape with the exception of a projection formed for the dispensing valve.

The paint toning machine according to the invention and especially the dispensing valve immersed in the color paste contained in the paste container have been described above only by way of example by means of a specific embodiment. It is to be understood that the idea according to the invention concerning the immersion of the dispensing valve in the color paste could also be realized with a separate dispensing valve of a more conventional structure, whereby the operating means thereof, of course, have to be suitable for such immersion. As the dispensing valve and the pipe connections thereof would be wholly immersed in the color paste in this kind of applications, too, the same advantages as described above can be achieved also in this case concerning leaks in the dispensing valve or its connections. Of course, other modifications, such as the leading of the drive shaft of the dispensing valve either through the side or through the bottom of the container, and the leading of the dispensing conduit through the side of the container, are also possible, without, however, deviating from the scope of protection defined in the attached claims.

What is claimed:

1. A paint toner dispensing machine comprising at least one color paste container having a bottom, a side wall, a cover and a floor positioned in the container above the bottom;

a gear-type pump located between the bottom and the floor for pumping color paste for the dispensing and circulation thereof; and a dispensing valve attached to the container for dispensing a desired amount of color paste, said dispensing valve being arranged in the paste container between the bottom and the floor thereof essentially below the surface of the color paste contained in the container, a paste feeding conduit to the dispensing valve being formed between the bottom and the floor, a paste circulating conduit and a paste dispensing conduit being formed in the floor and in the bottom, respectively;

said dispensing valve having a drive shaft which projects outside the paste container and goes through the floor via the paste circulating conduit, and a valve spindle having a first surface for closing the paste circulating conduit and a second surface for closing the paste dispensing conduit, a counter surface for the first surface of the spindle being formed in the floor and counter surface for the second surface of the spindle being formed in the paste container bottom.

2. A paint toner dispensing machine comprising at least one color paste container having a bottom, a side wall, a cover and a floor positioned in the container above the bottom;

a gear-type pump located between the bottom and the floor completely within the paste container for pumping color paste for the dispensing and circulation thereof; and a dispensing valve attached to the container for dispensing a desired amount of color paste, said dispensing valve being arranged completely within the paste container between the bottom and the floor thereof essentially below the surface of the color paste when the color paste is contained in the container, a paste feeding conduit to the dispensing valve being formed within the container between the bottom and the floor, a paste circulating conduit and a paste dispensing conduit being formed within the container in the floor and in the bottom, respectively;

said dispensing valve having a drive shaft which projects outside the paste container, and a valve spindle having a first surface for closing the paste circulating conduit and a second surface for closing the paste dispensing conduit, a counter surface for the first surface of the spindle being formed in the floor and counter surface for the second surface of the spindle being formed in the paste container bottom.

3. A paint toner dispensing machine according to claim 2, wherein said first surface and said second surface of the spindle are conical surfaces.

* * * * *